United States Patent [19]

Aronsson

[11] Patent Number: 4,798,117

[45] Date of Patent: Jan. 17, 1989

[54] METHOD OF PRODUCING BRICK-LIKE FACING ELEMENTS

[75] Inventor: Jan U. Aronsson, Vaxjo, Sweden

[73] Assignee: Hegri, B.V., Arnhem, Netherlands

[21] Appl. No.: 117,471

[22] Filed: Nov. 5, 1987

Related U.S. Application Data

[63] Continuation of Ser. No. 741,700, Jun. 6, 1985, abandoned.

[30] Foreign Application Priority Data

Jun. 6, 1984 [SE] Sweden ..... 8403035

[51] Int. Cl.[4] ..... B27F 1/18

[52] U.S. Cl. ..... 83/870; 144/193 R; 144/366

[58] Field of Search ..... 83/870; 144/193 A, 193 R, 144/193 D, 193 E, 366, 376

[56] References Cited

U.S. PATENT DOCUMENTS

| | | | |
|---|---|---|---|
| 1,716,991 | 6/1929 | Turner . | |
| 1,926,093 | 11/1931 | Gibney . | |
| 2,678,099 | 5/1954 | Provence | 83/870 |
| 2,847,721 | 1/1956 | Diamond . | |
| 3,248,834 | 10/1963 | Polis . | |
| 3,594,968 | 5/1969 | Johnson . | |
| 3,614,968 | 10/1971 | Hirz | 83/870 |
| 3,730,797 | 5/1973 | Jensen . | |
| 3,882,218 | 5/1975 | Bixel, Jr. . | |
| 3,916,966 | 11/1975 | Johnston et al. | 144/366 |
| 4,296,154 | 10/1981 | Ibberson . | |
| 4,417,493 | 11/1983 | Ohuchi et al. | 83/51 |

FOREIGN PATENT DOCUMENTS

| | | | |
|---|---|---|---|
| 1195660 | 6/1965 | Fed. Rep. of Germany | 52/390 |
| 167696 | 7/1959 | Sweden . | |
| 406102 | 8/1978 | Sweden . | |

*Primary Examiner*—Frank T. Yost
*Assistant Examiner*—Scott A. Smith
*Attorney, Agent, or Firm*—Merchant, Gould, Smith, Edell, Welter & Schmidt

[57] ABSTRACT

A panel-shaped facing element consists of a piece of a particle board which is split parallel to its flat sides.

2 Claims, 2 Drawing Sheets

METHOD OF PRODUCING BRICK-LIKE FACING ELEMENTS

Figure 1:
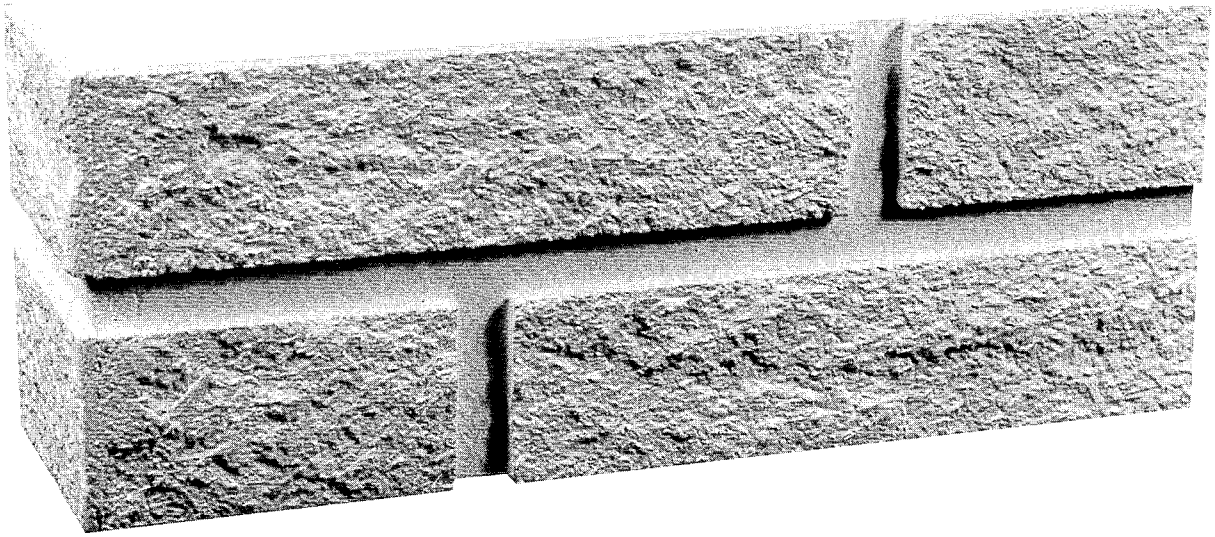
Figure 2:
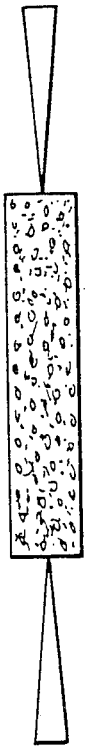

This is continuation of application Ser. No. 741,700, filed June 6, 1985, now abandoned.

The present invention relates to a panel-shaped facing element.

A prior art wall facing, called "GIDGEE" stone and manufactured by Gidgee Export Ltd, Israel, consists of a panel-shaped element of silicate sand with synthetic resin as the binding agent. This element which may be utilised for both interior and exterior covering of house walls is rather expensive, and mounting it on a wall requires the specific qualifications of an expert.

The object of the present invention is to provide a panel-shaped facing element, especially for covering the inside walls of a house, which element is cheaper and simpler to manufacture than the "GIDGEE" stone and also easier to mount. A further object of the present invention is to provide a panel-shaped facing element which has a rough surface, especially a surface with a brick-like or stone-like rough texture.

To this end, the present invention proposes a panel-shaped facing element which is characterised in that it consists of a piece of a particle board which is split parallel to its flat sides.

Preferably, the facing element is dimensioned to correspond to the surface of an ordinary brick.

The facing element according to the present invention is manufactured from a particle board from which pieces are cut which have a size corresponding to the desired dimensions of the facing elements. The facing elements and thus the cut pieces of particle board may, of course, be of any desired dimensions, but in a preferred embodiment they are dimensioned to correspond to the surface of a conventional brick, for example 6 ×25 cm. Since the cut particle board pieces are so small, cuttings and wastage which are obtained on manufacture and use of particle boards may be utilised advantageously.

The cut particle board pieces are placed in a splitting device to be split parallel to the flat sides of the particle board. A cleaving device utilised for this purpose has an upper movable cutting tool and a lower stationary cutting tool, between which the particle board piece to be split is placed. The two cutting tools are wedge-shaped and, to provide brick-like or stone-like rough surfaces in the split section, they have a wedge angle which, on splitting a 12 mm thick particle board piece, is about 10°. If the wedge angle is too large, there is a considerable risk of breaking the particle board piece instead of splitting it. If the wedge angle is reduced, less rough surfaces are obtained in the split section. By such splitting of a particle board piece, two facing elements according to the present invention are obtained, both having a smooth surface (one flat side of the original particle board) and a rough surface (the cut surface).

To cover a wall, the optionally shaped facing elements are mounted, with their rough surface facing away from the wall, by gluing in any desired pattern. If the facing elements have the above-mentioned "brick-shape", they may preferably be mounted on the wall in a pattern which simulates a brick wall construction such as that shown in the Figure. To further intensify this effect, the facing elements may be painted in a suitable "brick colour". The optionally designed and painted facing elements may be mounted on the wall in any pattern, for example a pattern which simulates a stone wall construction.

The facing elements according to the present invention may be glued to a supporting layer of any suitable size which may then be utilised as a pre-fabricated facing unit or module.

I claim:

1. A method of producing facing elements comprising the steps of providing a piece of particle board the length and width dimensions of which correspond with the same of a brick having generally parallel sides, locating said piece of particle board between two cutting tools, moving one of said cutting tools towards the other cutting tool to split the particle board along a plane parallel to its sides into two facing elements having rough brick-like surface.

2. A method according to claim 1 wherein the splitting step is accomplished with tools having a 10-degree wedge angle.

* * * * *